United States Patent [19]

Wantz

[11] Patent Number: 4,986,774

[45] Date of Patent: Jan. 22, 1991

[54] DESMODROMIC SHIFT ADAPTOR FOR A COUNTER-ROTATING PROPELLER SHAFT ASSEMBLY

[75] Inventor: David B. Wantz, Oshkosh, Wis.

[73] Assignee: Brunswick Corporation, Skokie, Ill.

[21] Appl. No.: 500,698

[22] Filed: Mar. 28, 1990

[51] Int. Cl.[5] ..... B63H 21/28

[52] U.S. Cl. ..... 440/75

[58] Field of Search ..... 440/75, 84, 86, 900; 74/378, 480 B; 192/21, 48.1

[56] References Cited

U.S. PATENT DOCUMENTS

| | | | |
|---|---|---|---|
| 3,487,803 | 1/1970 | Alexander | 440/75 |
| 3,919,964 | 11/1975 | Hagen | 440/75 |
| 4,530,667 | 7/1985 | McCormick | 440/75 |
| 4,820,210 | 4/1989 | Dretzka | 440/75 |
| 4,850,910 | 7/1989 | Higby et al. | 440/75 |
| 4,865,570 | 9/1989 | Higby et al. | 440/75 |

*Primary Examiner*—Sherman Basinger

*Assistant Examiner*—Stephen P. Avila

*Attorney, Agent, or Firm*—Andrus, Sceales, Starke and Sawall

[57] ABSTRACT

An adaptor member for accommodating use of a desmodromic cam-actuated shifting mechanism into a conventional propeller shaft cavity formed in the lower end of the gearcase of a marine propulsion system, wherein forward thrust on the propeller shaft is transferred to the gearcase at a point aft of the forward and reverse gears mounted about the propeller shaft. The adaptor member includes a cup, which is adapted to mount the fore one of the forward and reverse gears through a bearing member. The adaptor member further includes an internal passage within which is disposed the movable cam of the shifting mechanism, and an opening is in communication with the passage for allowing connection of the shift shaft to the shifting cam after assembly of the adaptor member into the gearcase cavity.

24 Claims, 2 Drawing Sheets

10
12
14
16
18
20
22
24
26
28
29
30
32
34
36
38
40
42
44
46
48
50
52
54
56
58
60
62
64
66
68
70
72
74
76
78
80
82
84
86
90
92
4

DESMODROMIC SHIFT ADAPTOR FOR A COUNTER-ROTATING PROPELLER SHAFT ASSEMBLY

BACKGROUND AND SUMMARY OF THE INVENTION

This invention relates to a marine propulsion system, and more particularly to an assembly for facilitating construction of a counter-rotating propeller shaft assembly.

In a conventional marine propulsion system, a vertical input shaft is provided with a drive gear at its lower end, which meshes simultaneously with forward and reverse gears mounted for free rotation about the propeller shaft. A clutch assembly is provided for selectively coupling either the forward gear or the reverse gear to the propeller shaft, so that the desired direction of rotation is imparted to the propeller shaft for driving the boat either in a forward direction or a reverse direction.

In a conventional drive, the forward gear is disposed in the fore end of a propeller shaft cavity formed in the lower end of the gearcase. Forward thrust on the propeller shaft is transferred through the propeller shaft to the forward gear, which is supported by a bearing abutting an internal shoulder formed in the propeller shaft cavity. The forward thrust is transferred from the forward gear to the bearing, and from the bearing to the gearcase through the internal shoulder.

A counter-rotating, or lefthand rotation, drive system is typically provided in one of the drives of a dual drive installation. This way, the propeller torque from the conventional system and the propeller torque from the counter-rotating system substantially cancel each other.

In a counter-rotating system, the propeller blades are pitched oppositely from a conventional system. The gear in the fore end of the propeller shaft cavity is the reverse gear, and the rearwardmost gear is the forward gear. With this arrangement, the forward thrust imparted to the propeller shaft must be transferred to the gearcase at a point rearwardly of the forward gear. Thus, the forward and reverse gears must be supported independently of the propeller shaft.

To absorb forward thrust in the propeller shaft, a flange or the like is provided on the propeller shaft at a point rearwardly of the gear set. A bearing and carrier assembly is disposed between the flange and an inwardly projecting rib formed on the inner wall of the propeller shaft cavity, for transferring forward thrust to the gearcase.

It is desirable, of course, to utilize a single gearcase casting both for the conventional drive system and for the counter-rotating drive system. It is an object of this invention to allow use of a conventional gearcase having a conventional propeller shaft cavity in assembling a counter-rotating drive system.

Assembling the components of a counter-rotating system into the gearcase cavity presents a number of difficulties when an integral flange is formed on the propeller shaft. It is further an object of this invention to provide ease of assembly of the components of a counter-rotating drive system into the gearcase cavity.

In accordance with the invention, a marine propulsion system includes a depending gearcase having a rotatable shift shaft mounted thereto and a propeller shaft cavity disposed toward its lower end. A propeller shaft is disposed in the propeller shaft cavity, and is adapted to be rotatably driven by a drive shaft and forward and reverse gears disposed within the cavity, for rotating a propeller connected to the propeller shaft. The propeller shaft is provided with means for transferring forward thrust in the propeller shaft to the gearcase at a point aft of the rearwardmost of the forward and reverse gears. The invention comprises an arrangement for facilitating assembly of a shifting mechanism and one of the forward and reverse gears within the cavity. An adaptor member, including means for rotatably supporting and fixing the position of the fore one of the forward and reverse gears within the gearcase cavity, comprises means for mounting a movable shifting cam to the adaptor member. The adaptor member accomodates connection of the shift shaft to the shifting cam. Mounting means is provided for mounting the adaptor member within the gearcase cavity and fixing its position relative to the gearcase. In a preferred embodiment, the adaptor member comprises cup means for rotatably supporting the fore one of the forward and reverse gears and fixing its position within the gearcase cavity. A bearing member is adapted to be received within the cup means, and the gear is mounted to the bearing member. The adaptor member, bearing and gear can be assembled on the outside and pressed into the forward end of the gearcase cavity so that the adaptor member abuts an internal shoulder formed in the cavity. The adaptor member includes a passage for receiving the movable shifting cam. When the adaptor member is mounted into the gearcase cavity, the shift shaft is inserted through an opening provided in the adaptor member so as to engage the shifting cam. An upstanding tube is preferably provided on the adaptor member toward its forward end, and is adapted to be received between a pair of cast inwardly projecting internal ribs formed in the gearcase cavity. During insertion of the adaptor member into the gearcase cavity, the tube is received between the cast ribs and is crushed, simultaneously providing proper location of the adaptor member within the gearcase cavity and thereafter non-rotatably fixing its position relative to the gearcase.

The invention also comprises a method of assembling a counter-rotating drive arrangement within the propeller shaft cavity of a gearcase. In accordance with this aspect of the invention, a first gear is rotatably mounted to an adaptor member. The adaptor member is mounted to the gearcase toward the fore end of the gearcase cavity, so as to fix the position of the first gear within the gearcase cavity. A drive gear is mounted to the input shaft, which is rotatably mounted within the gearcase, with the drive gear engaging the first gear. A shift mechanism is assembled within the propeller shaft. A propeller shaft assembly with a second gear and the shift mechanism is then assembled into the gearcase cavity, with the second gear engaging the drive gear and the shift mechanism extending into the adaptor member. The shift shaft, which is rotatably mounted to the gearcase, is connected through an opening provided in the adaptor member to the shift assembly coupled to the propeller shaft assembly, which has been inserted into the adaptor member. The propeller shaft and second gear are then secured within the gearcase cavity.

BRIEF DESCRIPTION OF THE DRAWINGS

The drawings illustrate the best mode presently contemplated of carrying out the invention.

In the drawings.

DETAILED DESCRIPTION OF THE PREFERRED EMBODIMENT

Figures 1, 2:
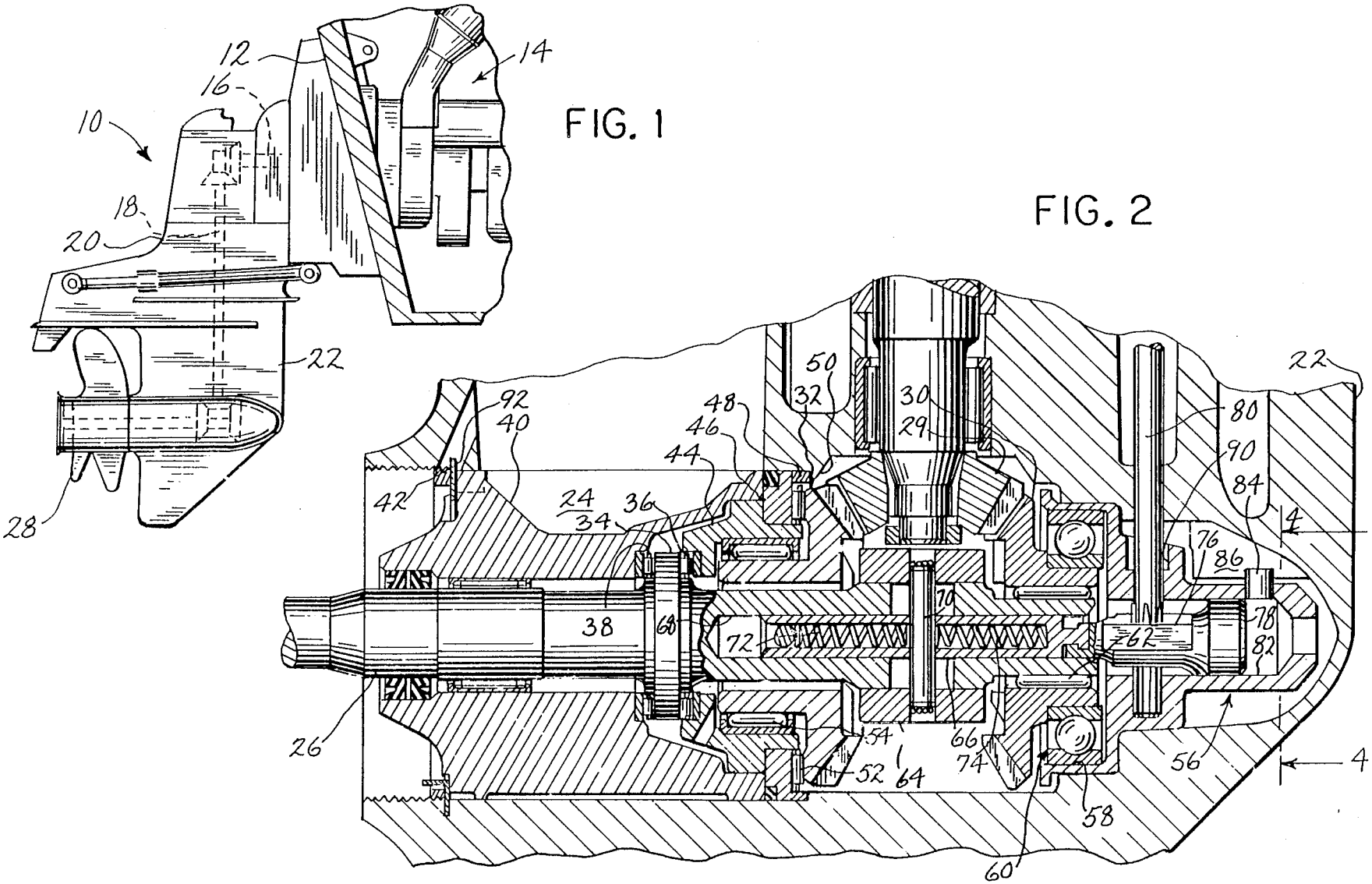
FIG. 1 is a partial side elevation view showing a stern drive marine propulsion system in which the invention is employed.
FIG. 2 is a sectional elevation view through the lower end of the gearcase of the stern drive system of FIG. 1, showing the counter-rotating drive assembly of the invention.

FIG. 1 illustrates a stern drive assembly 10 mounted to the transom 12 of a boat. An engine 14 is mounted in the interior of the boat. As is known, engine 14 includes an output shaft connected through a universal joint to a stern drive input shaft, shown at 16, which imparts rotation to a downwardly extending drive shaft 18 through a bevel gear set. Drive shaft 18 is rotatably supported within the drive shaft housing 20, and extends downwardly into the gearcase 22.

Referring to FIG. 2, gearcase 22 is provided with an internal propeller shaft cavity, shown at 24, within which is disposed a propeller shaft 26. While cavity 24 is designated as the propeller shaft cavity, it is understood that the components which transfer rotation of drive shaft 18 to propeller shaft 26 are housed within cavity 24.

The drive arrangement for imparting rotation to propeller shaft 26 is adapted to provide counter-rotation, or lefthand rotation, to propeller shaft 26. In an installation such as this, the propeller 28 (FIG. 1) connected to propeller shaft 26 is provided with appropriately pitched blades so that forward thrust is provided upon rotation of propeller shaft 26. This type of drive system is desirable in a dual drive arrangement, wherein one drive system provides conventional rotation of the propeller shaft and propeller, and the other drive unit, such as illustrated in FIGS. 1 and 2, provides counter-rotation. In this manner, the propeller torque of the drive units cancels.

As shown in FIG. 2, a drive pinion 29 is connected at the lower end of drive shaft 18. Drive pinion 29 is engaged with a fore reverse gear 30 and an aft forward gear 32. This arrangement is in contrast to a conventional drive system, wherein the fore gear is the forward gear and the aft gear is the reverse gear. In this manner, counter-rotation is imparted to propeller shaft 26 simply by reversing the action of the shift mechanism from that of a conventional drive system.

In a conventional drive system, where the fore gear is the forward gear, forward thrust in the propeller shaft is transferred through the forward gear directly through a bearing to a shoulder formed in the propeller shaft cavity. In a counter-rotating system as shown in FIG. 2, however, the forward thrust in the propeller shaft must be transferred to the gearcase at a point aft of forward gear 32, so as not to affect the interplay between drive pinion 29 and reverse and forward gears 30, 32. Referring to FIG. 2, a flange 34 is formed integrally with propeller shaft 26. A forward thrust bearing 36 and a rear thrust bearing 38 are provided on either face of flange 34. Rear thrust bearing 38 transfers rearward thrust on propeller shaft 26 to a bearing carrier 40, which is mounted within propeller shaft cavity 24 by means of a ring nut 42 engaged with internal threads provided in the walls of cavity 24. Forward thrust on propeller shaft 26 is transferred through forward thrust bearing 36 to a bearing adaptor 44 and to a thrust washer 46. Such thrust is transferred from thrust washer 46 to a spacer shim 48, which is engaged with an inwardly extending lip 50 formed on gearcase 22, so as to transfer forward thrust to gearcase 22.

Bearing adaptor 44 is adapted to receive a roller bearing 54, along with thrust washer 46 and a thrust bearing assembly 52 which supports forward gear 32.

An adaptor member 56 is placed at the forward end of propeller shaft cavity 24, and accomodates installation of reverse gear 30 and the shifting mechanism for selectively engaging either forward gear 32 or reverse gear 30 with propeller shaft 26. Adaptor member 56 includes an aft-opening cup portion having an inner wall 58, within which is placed a ball bearing assembly shown generally at 60. Reverse gear 30 is engaged with and supported by ball bearing 60. A needle bearing 62 is disposed between the inner passage formed in reverse gear 30 and the outer surface of the forward end of propeller shaft 26, for providing support thereto.

A clutch member 64 is mounted for back and forth movement on propeller shaft 26, in a manner as is known. A desmodromic shift system is provided for selectively moving clutch 64 into engagement with either forward gear 32 or reverse gear 30. The desmodromic shift system includes a clutch actuator rod 66 disposed within a passage 68 formed in the forward end of propeller shaft 26. A cross pin 70 is engaged with clutch actuator rod 66, for imparting sliding forward or rearward movement of clutch 64 in response to movement of clutch actuator rod 66. Springs 72, 74 are provided one on either side of pin 70, for biasing clutch 64 towards its center, or neutral, position.

A shifting cam 76, which is mounted to a cam follower 78, is connected to a rotatable shift shaft 80. Cam follower 78 is mounted within an internal passage 82 formed in adaptor member 56, for allowing sliding forward or rearward movement of cam follower 78 therein. Rotation of shift shaft 80 is transferred through shifting cam 76 to clutch actuator rod 66 through cam follower 78, for controlling the position of clutch 64.

Figure 4:
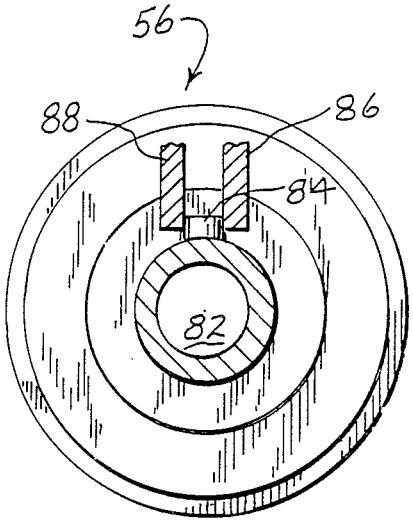
FIG. 4 is a partial sectional view taken generally along line 4—4 of FIG. 2.

As shown in FIG. 2, adaptor member 56 is provided with an upstanding locating tube 84 toward its forward end. Tube 84 is adapted to be received between a pair of downwardly extending cast ribs, one of which is shown in FIG. 2 at 86, which are integrally formed with gearcase 22. With reference to FIG. 4, it is seen that another rib, shown at 88, is spaced from rib 86, and that the upper end of locating tube 84 is received therebetween. The placement of locating tube 84 between ribs 86, 88 fixes the position of adaptor member 56 during push-on insertion of adaptor member 56 within cavity 24, providing proper alignment of adaptor member 56. With this arrangement, an upwardly facing shift shaft opening, shown at 90 (FIG. 2) is properly oriented so as to receive shift shaft 80 therethrough after placement of adaptor member 56 within cavity 24. Additionally, the wedging of tube 84 between ribs 86, 88 prevents rotational movement of adaptor member 56 after mounting to gearcase 22.

Figure 3:
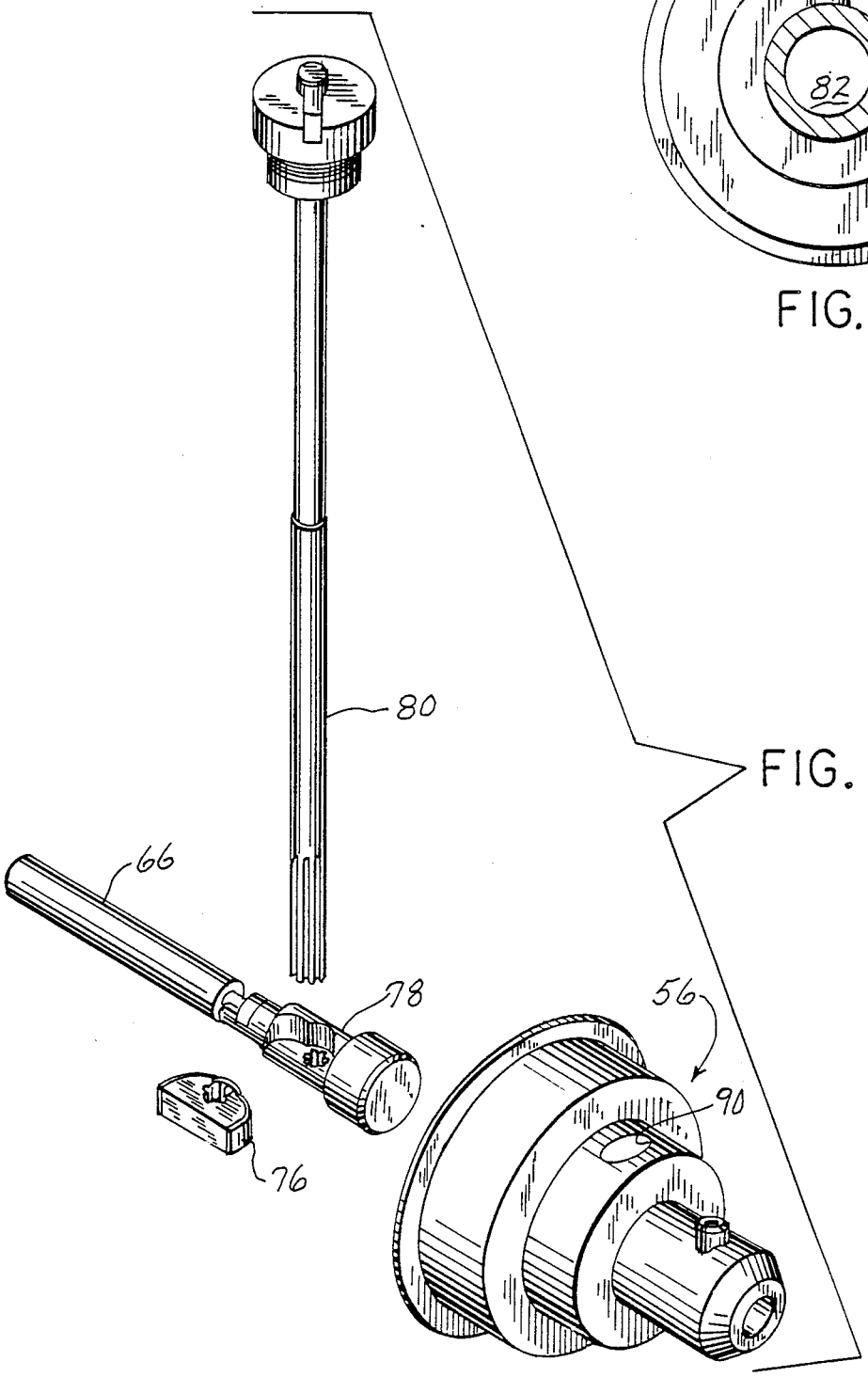
FIG. 3 is an exploded isometric view showing the adaptor member of the invention and the desmodromic shifting components adapted to be assembled thereto.

FIG. 3 illustrates adaptor member 56, shift shaft 80, cam follower 78, clutch actuator rod 66 and shifting cam 76. Shift shaft 80 is adapted to be inserted through opening 90 formed in adaptor member 56, after placement of cam follower 78 and shifting cam 76 within passage 82 formed in adaptor member 56.

To assemble the components shown in FIG. 2 within propeller shaft cavity 24, the following steps are undertaken. First, bearing member 60 is pressed into cup portion 58 of adaptor member 56, and reverse gear 30 mounted within the central passage through bearing member 60. This sub-assembly is then inserted into propeller shaft cavity 24 in an aft-to-fore direction. Locating tube 84 is positioned so that it is aligned with the space between ribs 86, 88 formed on gearcase 22. The push-on insertion of this sub-assembly is continued, so that the portion of locating tube 84 disposed between ribs 86, 88 is crushed by ribs 86, 88 as push-on insertion continues. This action serves to properly orient adaptor member 56 relative to the passage within which shift shaft 80 is to be mounted. The drive shaft is then inserted and the drive pinion 28 is then secured to the lower end of drive shaft 18. The propeller shaft sub-assembly is completed by assembling to propeller shaft 26 thrust bearing 36 and its race, bearing adaptor 44 and roller bearing 54, thrust washer 46, needle bearing 52 and forward gear 32. The clutch actuator rod and spring assembly (66, 68, 72, 74) is placed inside the propeller shaft and the clutch 64 is then positioned on propeller shaft 26 and cross pin 70 inserted between springs 74 of clutch actuator rod 66. Cam follower 78 and shifting cam 76 are then assembled to propeller shaft 26. This completed sub-assembly is then assembled into cavity 24. Bearing carrier 40 is then mounted into the aft portion of cavity 24, and the entire assembly is secured within cavity 24 by threaded ring 42 and a locking washer 92. Shift shaft 80 is then inserted through adaptor member opening 90 and aligned into shift cam 76.

Various alternatives and embodiments are contemplated as being within the scope of the following claims, particularly pointing out and distinctly claiming the subject matter regarded as the invention.

I claim:

1. In a marine propulsion system comprising a depending gearcase including a rotatable shift shaft mounted thereto and a propeller shaft cavity toward its lower end within which is disposed a propeller shaft adapted to be rotatably driven by a drive shaft and forward and reverse gears disposed within said cavity for rotating a propeller connected to said propeller shaft, wherein said propeller shaft is provided with means for transferring forward thrust in said propeller shaft to said gearcase aft of the rearwardmost of said forward and reverse gears, an arrangement for facilitating assembly of a shifting mechanism and one of said gears within said cavity, comprising:

an adaptor member including means for rotatably supporting and fixing the position of the fore one of said forward and reverse gears within said gearcase cavity, said adaptor member further comprising means for mounting a movable shifting cam thereto and accomodating connection of said shift shaft to said shifting cam; and means for mounting said adaptor member within said gearcase cavity and fixing the position of said adaptor member relative to said gearcase.

2. The arrangement of claim 1, wherein said means for rotatably supporting and fixing the position of the fore one of said forward and reverse gears comprises rearwardly opening cup means adapted to receive a bearing member and said gear.

3. The arrangement of claim 2, wherein said bearing member and said gear are assembled into said cup means outside of said gearcase and thereafter assembled into said gearcase.

4. The arrangement of claim 1, wherein said adaptor member includes an internal passage adapted to receive said movable shifting cam, and means accomodating connection of said shift shaft to said shifting cam.

5. The arrangement of claim 4, wherein said means accomodating connection of said shift shaft to said shifting cam comprises an opening formed in said adaptor member in communication with said passage for allowing connection of said shift shaft to said shifting cam.

6. The arrangement of claim 1, wherein said adaptor member includes a forward portion adapted for placement into the fore end of said gearcase cavity, and wherein said means for mounting said adaptor member within said cavity and fixing the position of said adaptor member comprises a structural member provided on the forward portion of said adaptor member for engaging structure provided on said gearcase toward the fore end of said gearcase cavity for non-rotatably mounting said adaptor member to said gearcase.

7. The arrangement of claim 6, wherein said structural member provided on the forward portion of said adaptor member comprises an upstanding tube member, and wherein said structure provided toward the fore end of said gearcase cavity comprises a pair of depending ribs, wherein push-on insertion of said adaptor member into said gearcase cavity locates said tube member between said ribs for providing proper orientation of said adaptor member and non-rotatably mounting said adaptor member to said gearcase.

8. The arrangement of claim 7, wherein said tube member has a transverse dimension greater than the space between said ribs, so that said tube member crushes during push-on insertion of said adaptor member into said gearcase cavity for firmly securing and fixing the position of said adaptor member relative to said gearcase.

9. An adaptor member for a marine propulsion system including a depending gearcase having a propeller shaft cavity in its lower end, within which is disposed a propeller shaft adapted to be rotatably driven by a drive shaft and forward and reverse gears disposed within said cavity for imparting rotation to a propeller connected to said propeller shaft, said propeller shaft being provided with means for transferring forward thrust in said propeller shaft to said gearcase aft of the rearwardmost of said forward and reverse gears, and a shift assembly including a rotatable shift shaft, a cam member operable in response to rotation of said shift shaft, and a clutch mechanism actuable by said cam member for selectively coupling either said forward gear or said reverse gear to said propeller shaft, said adaptor member being adapted for placement within said gearcase cavity toward its fore end and comprising:

cup means for rotatably supporting the fore one of said forward and reverse gears and fixing its position within said gearcase cavity; and means for movably supporting said cam member and accomodating connection of said shift shaft to said cam member.

10. The adaptor member of claim 9, further comprising means for mounting said adaptor member within said gearcase cavity and fixing the position of said adaptor member relative to said gearcase.

11. The adaptor member of claim 10, wherein said means for mounting said adaptor member and fixing its position comprises mating structure provided on said adaptor member and in said gearcase cavity adapted for engagement during push-on insertion of said adaptor member into said gearcase cavity for fixing the position of said adaptor member therewithin.

12. The adaptor member of claim 11, wherein said mating structure comprises an upstanding tube member provided at the forward end of said adaptor member and a pair of depending ribs formed in the fore end of said gearcase cavity, said tube member adapted to be received between said depending ribs during insertion of said adaptor member.

13. The adaptor member of claim 12, wherein the transverse dimension of said tube member is greater than the space between said depending ribs, so that said tube member crushes during insertion of said adaptor member into said gearcase cavity for securely fixing the position of said adaptor member within said gearcase cavity.

14. The adaptor member of claim 9, wherein said cup means is adapted to receive a bearing member, and said gear is engageable with said bearing member, and wherein said adaptor member, bearing member and gear are adapted for assembly externally of said gearcase cavity and thereafter mountable within said gearcase cavity by push-on insertion of said assembled adaptor member, bearing and gear into said gearcase cavity.

15. The adaptor member of claim 9, wherein said means for movably supporting said shifting cam comprises a passage formed in said adaptor member and extending forwardly of said cup means.

16. The adaptor member of claim 15, wherein said adaptor member is provided with an opening in communication with said passage for allowing insertion of said shift shaft therethrough for accomodating connection thereof to said shifting cam.

17. A method of assembling a propeller drive arrangement within an aft-opening propeller shaft cavity formed in the depending gearcase of a marine propulsion system, said gearcase including a rotatable drive shaft having its lower end disposed adjacent said cavity and a rotatable shift shaft having its lower end disposed adjacent said cavity, comprising the steps of:

providing a first gear;

providing an adaptor member;

rotatably mounting said first gear to said adaptor member;

mounting said adaptor member to said gearcase toward the fore end of said cavity so as to fix the position of said first gear within said cavity;

assembling a shift mechanism within said adaptor member;

connecting said shift shaft to said shift mechanism through an opening provided in said adaptor member;

mounting a drive gear to said input shaft, said drive gear engaging said first gear;

assembling a propeller shaft and a second gear into said gearcase cavity, said second gear engaging said drive gear; and securing said propeller shaft and said second gear to said gearcase within said cavity.

18. The method of claim 17, wherein said adaptor member includes rearwardly facing cup means, and wherein the step of rotatably mounting said first gear to said adaptor member comprises placing a bearing member within said cup means, and mounting said first gear to said bearing member.

19. The method of claim 18, wherein said adaptor member, bearing member and gear are assembled into a sub-assembly externally of said gearcase cavity, and thereafter mounted within said gearcase cavity.

20. The method of claim 19, wherein the step of mounting said adaptor member to said gearcase comprises push-on insertion of said adaptor member into said gearcase cavity toward the fore end of said gearcase cavity.

21. The method of claim 20, wherein said adaptor member is provided with an upstanding tube member and said gearcase cavity is provided with a pair of spaced depending ribs, and wherein the step of mounting said adaptor member to said gearcase comprises orienting said adaptor member such that said tube member is disposed between said depending ribs so as to provide proper orientation of said adaptor member.

22. The method of claim 21, wherein said tube member has a transverse dimension greater than the space between said depending ribs, so that, upon push-on insertion of said adaptor member into said gearcase cavity, said tube member engages said ribs and is crushed therebetween so that, after mounting of said adaptor member to said gearcase, rotation of said adaptor member is prevented.

23. The method of claim 19, wherein said shift mechanism includes a rotatable shifting cam, and wherein assembling said shift mechanism within said adaptor member comprises movably mounting said shifting cam within a passage provided in said adaptor member.

24. The method of claim 23, wherein the step of connecting said shift shaft to said shift assembly comprises orienting said shifting cam so as to be disposed adjacent the opening provided in said adaptor member, for allowing connection of said shift shaft to said shifting cam therethrough.

* * * * *